United States Patent [19]

Flocke et al.

[11] 4,451,176

[45] May 29, 1984

[54] APPARATUS FOR AND METHOD OF DRIVING TUNNELS

[75] Inventors: Günter Flocke, Lünen; Hans Jütte, Dortmund-Brechten; Klaus Linde; Winfried Klamke, both of Lünen; Werner Hampel, Selm, all of Fed. Rep. of Germany

[73] Assignee: Gewerkschaft Eisenhutte Westfalia, Lünen, Fed. Rep. of Germany

[21] Appl. No.: 398,681

[22] Filed: Jul. 15, 1982

Related U.S. Application Data

[63] Continuation of Ser. No. 149,979, May 15, 1980, abandoned.

[30] Foreign Application Priority Data

May 30, 1979 [DE] Fed. Rep. of Germany ..... 2921907

[51] Int. Cl.[3] ..... E21D 9/06; E21D 11/10

[52] U.S. Cl. ..... 405/146; 405/150

[58] Field of Search ..... 405/138, 141, 145, 146, 405/150; 249/10, 11

[56] References Cited

U.S. PATENT DOCUMENTS

| | | | |
|---|---|---|---|
| 3,550,382 | 12/1970 | Khodosh | 405/146 X |
| 3,561,223 | 2/1971 | Tabor | 405/146 X |
| 4,043,137 | 8/1977 | Jutte | 405/150 X |
| 4,120,165 | 10/1978 | Stuckmann | 405/145 |
| 4,147,453 | 4/1979 | Unger et al. | 405/141 |
| 4,222,681 | 9/1980 | Khodosh | 405/141 |

*Primary Examiner*—Cornelius J. Husar
*Assistant Examiner*—Nancy J. Stodola
*Attorney, Agent, or Firm*—Thompson, Birch

[57] ABSTRACT

Apparatus for, and a method of, driving a tunnel utilizes a drive shield to support the forward end of the tunnel where debris material is removed. At the rear end of the drive shield, a lining is created to cover the exposed tunnel wall. This lining is produced by simply spraying concrete rearwardly directly between the space between multi-part formwork and the tunnel wall itself. The formwork may overlap with the drive shield. The formwork is advanced to follow the progress of the drive shield by removing part of the formwork from the rear and re-siting this part at the front end.

11 Claims, 2 Drawing Figures

APPARATUS FOR AND METHOD OF DRIVING TUNNELS

This application is a continuation of application Ser. No. 149,979, filed May 15, 1980, now abandoned.

BACKGROUND TO THE INVENTION

The present invention relates to apparatus for and a method of driving underground excavations such as galleries, roadways, adits or the like collectively referred to as "tunnels".

It is known to drive an underground tunnel with the aid of a drive or knife shield which supports the forward region of the tunnel at a working face where debris material is removed. To protect the tunnel wall exposed as the drive shield advances various measures are adopted and it is usually desirable to create a concrete lining for the tunnel wall. In one known method the tunnel wall is covered with reinforcements such as mats and mesh or bars and concrete is sprayed over the covered wall to encase the reinforcements. Only a comparatively thin layer of concrete is produced as a temporary support or to seal the tunnel wall. Further measures are then necessary to make the proper permanent lining if this is desired. In another known method concrete is pumped into a space between a formwork and the tunnel wall. This space is sealed off by a screen at the front side and the concrete hardens to form the permanent tunnel wall lining. German published patent specification No. 1290161 describes formwork which is composed of a front tubular body and a rear tubular body which is radially expandible. Double-acting hydraulic rams are interposed between the front and rear bodies and serve to advance the formwork to follow up the drawing progress. Temporary support is necessary at the front end of the formwork to prevent subsidence. By moving the formwork in the tunnel driving direction and by radially expansion of the rear body the density of the concrete is affected and the strength of the lining can be impaired. Difficulties also occur with the concrete section between the bodies.

Typically, prior art methods of driving tunnels where concrete linings are produced involve screens and filters to close off the concrete—reception space and/or create linings without uniform density. Further examples of known tunnel driving methods and apparatus are described in U.S. Pat. Nos. 3,834,170, 4,063,425, 4,084,386, 4,118,938 and 4,147,453 assigned to the assignee of this application.

A general object of this invention is to provide an improved apparatus and method for tunnel driving.

SUMMARY OF THE INVENTION

In accordance with the invention a tunnel is driven with the aid of a drive shield and a rear multipart formwork as known per se. The formwork may overlap with the drive shield. In accordance with the invention, concrete is sprayed directly rearwardly from the shield between the formwork and the tunnel wall. The formwork is advanced by removing a rear part and resiting the removed part at the front end of the formwork. The formwork has an overall length sufficient to ensure the concrete is self-supporting at its rear end where a part is to be removed for re-location at the front end. Temporary supports or screens and/or filters are not necessary at the tunnel wall exposed behind the shield can be immediately covered with a concrete layer supported by the formwork. The formwork remains to support the concrete until it becomes self supporting and the concrete can remain undisturbed thus, preserving uniform density.

Hydraulic rams can be located between the shield and the formwork. In this case, the shield can employ a continuous casing contacting the tunnel wall and the shield can be advanced with these rams with the formwork acting as an abutment. The length of the formwork is also sufficient to absorb the thrust forces exerted by the rams to advance the shield and to produce sufficient frictional resistance with the concrete lining.

It is preferable to provide the shield or its casing, which may be composed of elongate knife-like drive members as known per se, with a reduced thickness rear region and to have this reduced region overlap with the formwork. This reduction may be a step-like reduction or a continuous, i.e. tapered, reduction. This reduced rear region facilitates the concrete spraying by enlarging the area between the formwork and the rear region where the concrete enters directly.

The invention may be understood more readily, and various other features and aspects of the invention may become apparent, from consideration of the following description.

BRIEF DESCRIPTION OF THE DRAWING

Embodiments of the invention will now be described, by way of examples only, with reference to the accompanying drawing, wherein.

DESCRIPTION OF PREFERRED EMBODIMENTS

Figure 1:
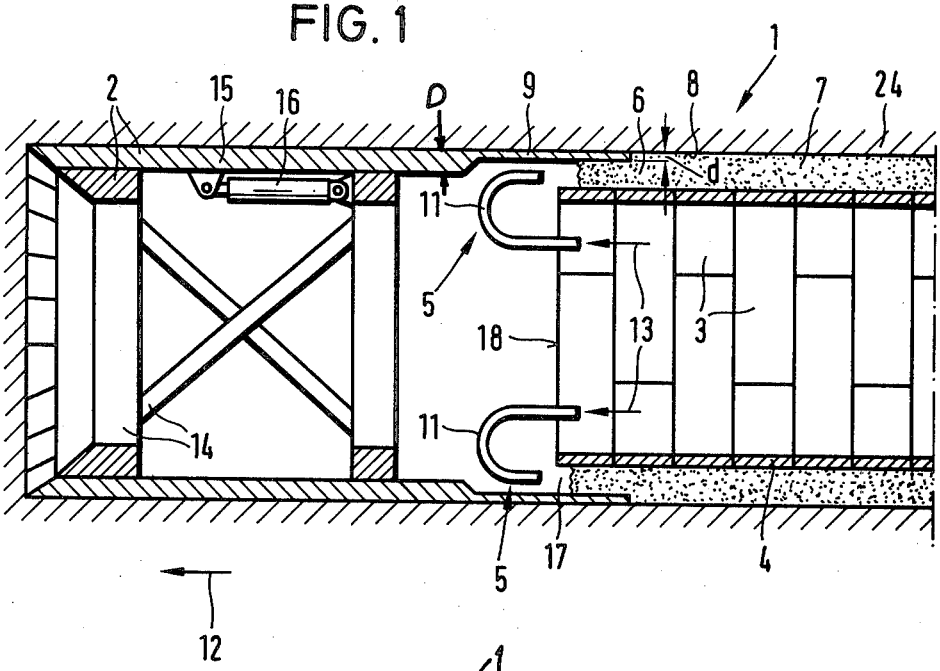
FIG. 1 is a schematic sectional side view of apparatus made in accordance with the invention.

Referring to FIG. 1, apparatus for performing the method of the invention, is installed in a tunnel 1 excavated underground and is composed of a drive shield 2 at the forward end of the tunnel 1 and displaceable formwork 4 disposed rearwardly of the shield 2 relative to the direction of advancement of the tunnel 1. The shield 2 is itself of known design and can employ a continuous steel casing 15, or a series of elongate drive members or planks 15, arranged side-by-side, supported for displacement on a frame 14. The rear portion 9 of the casing 15 or of each of the drive members 15 is reduced in thickness from a full thickness "D" to a reduced thickness "d". This rear portion 9 partially overlaps the formwork 4. Hydraulic rams 16 are connected between the frame 14 and the casing 15 or drive members 15 and serve alternately to advance these respective components. Where the shield utilizes a plurality of drive members 15, these drive members are advanced individually or collectively in groups in the tunnel driving direction with the aid of the associated rams 16. Thereafter the rams 16 act to draw up the frame 14 to follow the advancement of the drive members 15.

The formwork 4, which is spaced from the tunnel wall 8 exposed as the shield 2 is advanced, is composed of tubbing segments 3 arranged to form individually ring elements disposed end-to-end. Means 5 serves to spray concrete 6 directly into the open space 7 between the formwork 4 and the tunnel wall 8, and between the formwork 4 and the rear portion 9 of the shield 2 casing.

This means 5 is represented by two pipes 11 which are curved to direct the concrete fed into the pipes 11 in the forward direction of arrows 13 as a spray passed rearwardly into the space 7. The reduced rear portion 9 of the shield 2 casing enlarges the operating space for the spraying operations. As the shield 2 is advanced with the rams 16 concrete is continuously sprayed into the space 7. The pipes 11 can be pivoted or swivelled, manually or otherwise to bring their openings around the entire open area 17 at the forward side of the space 7 and the concrete can be sprayed quite evenly. As the applied concrete 6 approaches the forward end 18 of the formwork 4, a complete ring element composed of three tubbing segments 3 is removed from the rear end of the formwork 4 and is re-sited at the front end of the formwork 4. In this way the formwork 4 follows up the advancement of the shield 2 and the tunnel progresses. The length of the formwork 4 is sufficient to ensure the concrete 6 at the rear end portion of the formwork 4 is self-supporting where the rear end ring element is to be removed. The remainder of the formwork 4 supports the concrete while it is setting.

Figure 2:
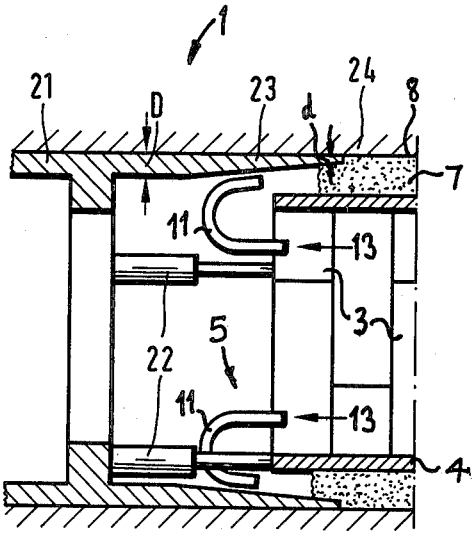
FIG. 2 is a schematic sectional side view of part of another apparatus made in accordance with the invention.

In the modified apparatus shown in FIG. 2, like reference numerals denote like parts. The drive shield of FIG. 2 employs a continuous casing denoted 21 instead of individual drive members and the frame 14 can be omitted. Hydraulic rams 22 are here interposed between the shield or casing 21 and the formwork 4. The rams 22 extend parallel to the axis of the tunnel being driven and are distributed around this axis. The casing 21 is advanced with the rams 22 and the formwork 4 acts as an abutment for the shifting forces. The overall length of the formwork 4 produces sufficient frictional resistance with respect to the concrete 7 to absorb the thrust forces exerted by the rams 22 and also ensures the concrete is self-supporting at the rear end as before. The rear end portions 23, of the casing 21 is tapered continuously to decrease in thickness from the full thickness "D" towards the rear end. The concrete is applied as described previously.

In both the embodiments as represented, the rear portion 9, 23 of the shield or its casing overlaps the forward region of the formwork 4. This is especially suitable for driving tunnels in comparatively soft subsoils, designated 24, since displacement of the sub-soil 24 can be prevented. With firmer materials, however, it is possible to decrease or eliminate this overlap so that the front end 18 of the formwork 4 is more or less in line with the rear end of the shield or casing 9, 23. In this case the concrete would be sprayed directly between the tunnel wall 8 and the formwork 4.

It is also possible to utilize a shield which has elongate drive members or a casing connected to the so-called rear tail members or a rear casing which form the rear portions 9,23. Thus in this case the rear portion would not be integral with the front portion of the shield casing as illustrated.

If extra strength in the concrete lining is desired reinforcements such as mesh, bars or the like can be introduced into the space 7 from the front end where the concrete is sprayed in. These reinforcements can then become encased in the sprayed concrete and hence in the resultant lining.

We claim:

1. An apparatus for use in tunnel driving, comprising: an advanceable drive shield for supporting the forward region of a tunnel wall during excavation, formwork located rearwardly of the drive shield relative to the direction of the tunnel driving, the formwork being of multi-part construction and advanceable to follow up the drive shield by removal of a rear part and re-siting of the rear part at the front end of the formwork, the formwork cooperating with the tunnel wall to define an annular space with an open front region facing said drive shield for receiving concrete used to create a lining for the tunnel wall, and movable spray means for rearwardly spraying concrete through and around said open front region into said space to fill said space and to create said lining, said front region remaining open while concrete is sprayed into said space to accommodate movement of said spray means, thereby achieving an even distribution of the sprayed concrete.

2. Apparatus according to claim 1, wherein the formwork overlaps with the drive shield.

3. Apparatus according to claim 1, wherein the hydraulic rams are located between the drive shield and the formwork.

4. Apparatus according to claim 1, wherein the drive shield has a rear portion of reduced thickness contacting the tunnel wall over a region preceding the lining.

5. Apparatus according to claim 2, wherein the drive shield has a rear portion overlapping the formwork, the rear portion having reduced thickness and contacting the tunnel wall over a region preceding the lining.

6. Apparatus according to claim 4, wherein the rear portion has a tapered profile.

7. Apparatus according to claim 4, wherein the rear portion is reduced in thickness as a step-like transition.

8. Apparatus according to claim 1, wherein the drive shield employs a continuous outer casing contacting the tunnel wall.

9. Apparatus according to claim 1, wherein the drive shield employs elongate drive members mounted side-by-side in contact with the tunnel wall and individually advanceable in the tunnel driving direction.

10. A method of driving a tunnel, comprising: utilising an advanceable drive shield to support the forward region of the tunnel wall during driving, utilising a multi-part formwork located behind the drive shield to cooperate with the tunnel wall in defining an annular space with an end facing towards the drive shield which remains open and through which may be received concrete used to create a lining for the tunnel wall; utilizing spray means directed rearwardly into and movably around the open end of said space to spray concrete evenly, thereby filling said space, and advancing the formwork to follow up the drive shield by removing a rear part of the formwork and re-siting the rear part at the front end of the formwork.

11. A method according to claim 10, wherein the drive shield has a reduced thickness rear portion contacting the tunnel wall and overlapping the formwork and the concrete is sprayed between the rear portion of the shield and the formwork to enter the space.

* * * * *